US005241913A

United States Patent [19]

Weber

[11] Patent Number: 5,241,913

[45] Date of Patent: Sep. 7, 1993

[54] REINFORCED BOLSTER FOR A RAILROAD CAR TRUCK

[75] Inventor: Hans B. Weber, Rotonda West, Fla.

[73] Assignee: National Castings, Inc., Lisle, Ill.

[21] Appl. No.: 898,709

[22] Filed: Jun. 15, 1992

[51] Int. Cl.[5] ..... B61F 5/00

[52] U.S. Cl. ..... 105/230; 105/208; 105/226

[58] Field of Search ..... 105/202, 203, 207, 208.2, 105/226, 227, 228, 229, 230, 171, 185, 190.1, 190.2, 192, 197.05

[56] References Cited

U.S. PATENT DOCUMENTS 541,326 6/1895 Goltra ..... 105/208
875,058 12/1907 Frame ..... 105/208
1,314,183 8/1919 Bubenheim ..... 105/203
3,670,660 6/1972 Webber et al. ..... 105/208.2

*Primary Examiner*—Mark T. Le

[57] ABSTRACT

A bolster of a railroad car truck is shallow and has a unique reinforcement rib which extends longitudinally of the bolster between a pair of stops which are designed to engage adjacent abutments which are carried by a transom to limit relative axial movement between the bolster and transom. The transom is generally flat and is provided with an elongated slot between the abutments to receive the reinforcement rib should the bolster, under load, deflect toward the transom a distance where the rib would contact the transom, if it were not for the slot in the transom.

5 Claims, 1 Drawing Sheet

REINFORCED BOLSTER FOR A RAILROAD CAR TRUCK

BACKGROUND OF THE INVENTION

The invention relates to railroad cars, especially the trucks or bogies which are located at the opposing ends of a railroad car to support the car on the rails of a trackway. More particularly, the invention relates to a truck which is manufactured and sold by National Castings Incorporated of Lisle, Ill. under the trademark SWING MOTION. A detailed description of this quality truck with excellent high speed performance characteristics is found in U.S. Pat. No. 3,670,660. The SWING MOTION truck is manufactured from many different steel parts, and essentially comprises a pair of rigid sideframes which are held in parallel relation by a transom and juxtaposed bolster which are coupled in parallel, transverse relation between the sideframes. Each of the sideframes includes a pair of pedestals which are in side-by-side aligned, spaced relation. Each of the pedestals is basically an inverted, generally U-shaped, rigid frame which is designed to support an axle box with roller bearings in which one end of an axle with an attached pair of wheels, is mounted for rotation.

The SWING MOTION truck was designed at a time when railroad cars were smaller than presently built cars which are bigger, heavier, and capable of carrying much larger loads. A study of this particular truck reveals sideframes which are exceptionally strong and probably need no reinforcing. The invention is directed to substantially increasing the strength of the bolster without adversely effecting the relationship between the bolster and adjacent transom.

Briefly stated, the invention is in the provision of a longitudinally extending reinforcement rib on the underside of the bolster closest the transom. An elongated slot is placed longitudinally in the transom between the parallel marginal edges of the transom, to receive the rib should the load springs which support the bolster, come under heavy loading and deflect to a point where the rib would contact the transom, if the slot were not in the transom. Thus, the integrity or relationship between the bolster and transom is maintained, while the strength of the bolster is increased.

DESCRIPTION OF THE DRAWING

The following description of the invention will be better understood by having reference to the accompanying drawing, wherein.

DETAILED DESCRIPTION OF THE DRAWING

Figure 1:
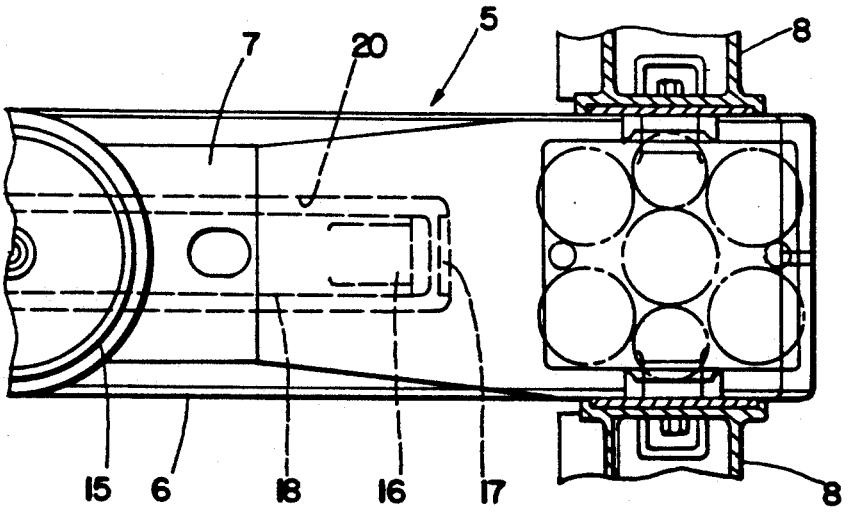
FIG. 1 is a plan view of a portion of a railroad car truck or bogie which includes one-half of a bolster and parts of an attached sideframe.
Figure 2:
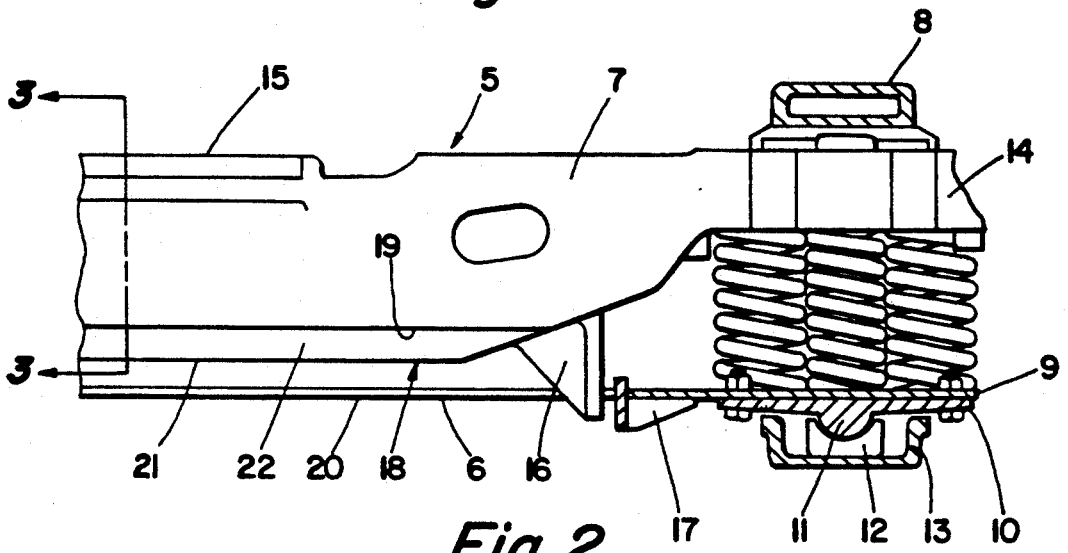
FIG. 2 is a side view of the same portion of the truck.

With reference to FIGS. 1 and 2, there is shown a portion of a railroad car truck or bogie 5 which comprises a transom 6 and bolster 7 which are separately coupled between a pair of similar sideframes 8. The new transom 6, unlike the old transom of the SWING MOTION truck with the dished down center section, is generally flat having a planar web with parallel marginal edges which are upturned slightly in the direction of the overhead bolster 7. Thus, the transom 6 can be said to have a generally U-shaped cross-section as it extends transversely between the sideframes 8. The new transom 6, like the old one, has a pair of opposing ends 9 which, as best seen in FIG. 2, are each similarly bolted to a rocker seat 10 which extends transversely of the transom 6 and has a pair of opposing ends 11 which are supported on a pair of identical, hardened steel rocker seat bearings 12. Each pair of rocker seat bearings 12 are supported in a separate U-shaped channel 13 that is formed in an adjacent sideframe 8.

The new bolster 7, unlike the old bolster of the SWING MOTION truck with the enlarged center section, is more shallow throughout its length and has a generally rectangular cross-section, as it extends in juxtaposed relation above the transom 6, when the truck 5 is in a horizontal position. The new bolster 7, like the old one, has a pair of opposing ends 14 which are similarly coupled to the sideframes 8 independently of the transom 6. The new bolster 7 also has a round center plate 15 which is fastened to a corresponding plate on the underside of a railroad car. The new bolster 7 is likewise provided with a pair of oppositely disposed, longitudinally spaced stops 16 which are designed to project from the bolster 7 into contact with a pair of adjacent, conventional abutments 17 which are carried by the transom 6 to limit relative axial movement between the new bolster 7 and transom 6.

Figure 3:
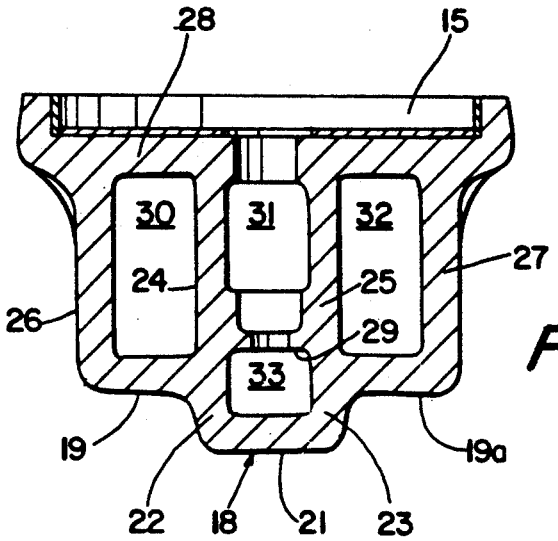
FIG. 3 is a section of the bolster viewed from the line 3—3 of FIG. 2.

With particular reference to FIG. 3, the new bolster 7 is provided with a reinforcement rib 18 which extends longitudinally of the bolster 7 between the spaced stops 16. The rib 18 is integrally formed or cast with the bolster 7, and projects from the bottom side 19 of the bolster 7 in the direction toward the transom 6. An elongated slot 20 is disposed centrally of the transom 6 between the stops 17 to matingly receive the rib 18, when the bolster 7 deflects to a point where the rib 18 would contact the transom 6, if it were not for the slot 20.

The reinforcement rib 18 can be solid, or hollow, if it is desirous to keep the weight of the bolster 7 down without adversely effecting the strength of the rib 18. As seen in cross-section, the bottom planar wall 21 of the rib 18, closest to the transom 6, is parallel to the adjacent, bottom side 19 of the bolster 7. In this instance, the bottom side 19 of the bolster 7 is split into a pair of aligned, planar, bottom sides 19 and 19*a*. The parallel side walls 22 and 23 of the rib 18 are planar extensions of a pair of flat webs 24 and 25 which are formed interiorly of the bolster 7 in parallel relation with the outer, planar sides 26 and 27 of the bolster 7. The generally flat top side 28 of the bolster 7, farthest spaced from the transom 6, acts to enclose the bolster 7, and gives the bolster 7 a box-like configuration with a longitudinally projecting rib 18.

A special web 29 with a configured opening connects the interior webs 24 and 25 between the bottom wall 21 of the rib 18 and the top side 28 of the bolster 7 in the area of the center plate 15, and is designed to receive a center pin (not shown) which is used to align the railroad car body on the bolster 7. The weight of the bolster 7 is minimized by placing in the bolster 7 and rib 18, strategically located voids or cavities 30–33 which do not materially effect the strength of the bolster 7.

Thus, there has been described a unique combination of a flat transom and a reinforced shallow bolster for a railroad car truck. The relatively simple structures of these two members makes them more economical to manufacture. Moreover, the unique interaction between these two members does not adversely effect the normal function of them in stabilizing the truck.

What is claimed is:

1. A railroad car truck, comprising:

a) a transom coupled between a pair of sideframes, the transom including an elongated slot disposed centrally and longitudinally of the transom, the slot terminating in spaced relation from opposing ends of the transom;

b) an abutment carried by the transom at each end of the slot;

c) a bolster coupled between the sideframes in juxtaposed relation above the transom, when the truck is in a horizontal position, the bolster including;

i) a pair of longitudinally spaced stops projecting from the bolster for engaging the abutments of the transom to limit relative axial movement between the bolster and transom;

ii) a bottom side which is flat between the stops and which comprises a pair of spaced, planar segments adjacent the transom;

iii) a single, hollow reinforcement rib disposed longitudinally of the bolster between the stops, the rib projecting from the bottom side of the bolster in a direction toward the transom, the rib comprising, I) a bottom wall which parallels the spaced, planar segments of the bottom side of the bolster, and which is in closer spaced relation to the transom than the segments, and II) a pair of side walls extending in parallel relation from opposing marginal edges of the bottom wall of the rib in a direction away from the transom, the side walls being axial extensions of a pair of parallel, planar webs which are disposed interiorly of the bolster in parallel relation with a pair of exterior, planar sides of the bolster, the interior planar webs and side walls being connected to the segments in spaced relation from connections between the segments and the sides of the bolster, the rib designed to be received in the slot in the transom, when the bolster deflects towards the transom a distance which would cause the rib to contact the transom, if it were not for the slot in the transom.

2. The truck of claim 1, wherein the transom has a flat, planar web with parallel marginal edges.

3. The truck of claim 2, wherein the bolster includes voids separating the webs and sides of the bolster.

4. The truck of claim 3, wherein the bolster has a round center plate for fastening to the underside of a railroad car, and includes a special web with a configured opening, connecting the interior planar webs of the bolster and located between the bottom wall of the rib and the top side of the bolster, the opening of the special web and the center plate being coaxially aligned.

5. A railroad car truck, comprising:

a) a pair of rigid sideframes disposed in parallel relation;

b) a transom coupled between the sideframes in transverse relation to the sideframes, the transom being generally flat, having a planar web with parallel marginal edges which extend from the plane of the web in transverse parallel relation, the transom having a pair of abutments which are spaced longitudinally of the web and extend from the plane of the web, the transom having an elongated slot which extends longitudinally of the transom between the abutments, the slot being disposed centrally of the transom between the marginal edges thereof; and c) a bolster coupled separately between the sideframes in juxtaposed relation above the transom, when the truck is in a horizontal position, the bolster being generally shallow and having a box-like configuration with a reinforcement rib which projects from the box-like configuration in the direction toward the transom, the rib extending longitudinally of the bolster between a pair of stops which are spaced longitudinally of the bolster and project from the box-like configuration for engaging the abutments of the transom to limit relative axial movement between the bolster and transom, the bolster having a cross-section midway between the sideframes which includes, I) a planar top side farthest spaced from the transom and generally parallel thereto, the top side having a pair of parallel marginal edges, II) a pair of planar, outer sides which extend transversely from the marginal edges of the top side in parallel relation towards the transom, the outer sides terminating at marginal edges in spaced relation from the top side, III) a pair of planar, bottom sides extending from the marginal edges of the outer sides towards each other and terminating at a pair of parallel marginal edges which are in predetermined spaced relation, IV) a pair of planar webs disposed interiorly of the bolster in parallel relation with the outer sides of the bolster, the webs being connected between the top side and parallel marginal edges of the bottom sides, V) a pair of relatively short side walls, compared to the outer sides, extending from the webs and being a planar extension of the webs, the side walls being a part of the reinforcement rib and terminating at marginal edges which are in spaced relation from the bottom sides, and VI) a bottom wall connecting the marginal edges of the side walls of the rib, the bottom wall of the rib being parallel to the top side and bottom sides of the bolster.

* * * * *